US005217569A

United States Patent [19]

Hodgens, II et al.

[11] Patent Number: 5,217,569

[45] Date of Patent: * Jun. 8, 1993

[54] CHEMICAL MILLING SOLUTION FOR REDUCED HYDROGEN ABSORPTION

[75] Inventors: Henry M. Hodgens, II, Jupiter; Kenneth C. Long, Stuart; Robert E. Fishter, Boca Raton, all of Fla.

[73] Assignee: United Technologies Corporation, Hartford, Conn.

[ * ] Notice: The portion of the term of this patent subsequent to Apr. 7, 2009 has been disclaimed.

[21] Appl. No.: 816,369

[22] Filed: Dec. 31, 1991

Related U.S. Application Data

[63] Continuation-in-part of Ser. No. 637,905, Jan. 7, 1991, Pat. No. 5,102,499.

[51] Int. Cl.[5] ..... B44C 1/22; C73F 1/00

[52] U.S. Cl. ..... 156/664; 156/654; 252/79.3; 252/79.4

[58] Field of Search ..... 156/656, 664, 659.1, 156/903, 654; 252/79.2, 79.3, 79.4

[56] References Cited

U.S. PATENT DOCUMENTS 5,102,499 4/1992 Jodgens ..... 156/664

*Primary Examiner*—William A. Powell
*Attorney, Agent, or Firm*—Robert J. Parizek

[57] ABSTRACT

A solution is described for the chemical processing of beta phase-containing titanium alloys. The solution contains $HNO_3$ and HF, along with a small but effective amount of copper, ruthenium, rhodium, palladium, osmium, iridium, platinum or gold to reduce hydrogen absorption, ammonium formate and citric acid to increase the milling rate, and a surfactant to ensure a satisfactory milled surface.

4 Claims, 3 Drawing Sheets

CHEMICAL MILLING SOLUTION FOR REDUCED HYDROGEN ABSORPTION

The invention was made under a U.S. Government contract and the Government has rights herein.

This application is a continuation-in-part of U.S. Ser. No. 7/637,905 filed on Jan. 7, 1991, U.S. Pat. No. 5,102,499.

TECHNICAL FIELD

This invention relates to the chemical milling of metals and alloys, particularly titanium, and more specifically to additions to a chemical milling solution to reduce the absorption of hydrogen by the metal being chemically milled.

BACKGROUND ART

Titanium alloys are useful in the aerospace industry because of their high strength to weight ratios at elevated temperatures. The benefits of achieving minimum weight in aircraft components are so significant that extreme techniques are frequently employed to achieve complex geometries and to reduce section thicknesses of components to the absolute minimum dimension permissible by design standards.

Usually, components which are fabricated from sheet or plate material of uniform thickness will have excess material in low stress regions. However, in the interest of saving weight, components are generally fabricated so that material which is not required for load support in a structure is removed.

Conventional mechanical machining techniques, such as milling, are often used to remove material, but these techniques are labor intensive, and generally require expensive machinery which must be operated by highly skilled personnel.

Chemical removal methods are also frequently employed. An aqueous solution containing various acids and often other additives, dissolves material from the surface of the metal. Hydrofluoric acid (HF) in concentrations up to about 10%, usually in combination with one or more other acids, such as hydrochloric acid (HCl), nitric acid ($HNO_3$), phosphoric acid ($H_3PO_4$), sulfuric acid ($H_2SO_4$), and various organic acids, in aqueous solution, is commonly used for the chemical milling of titanium and its alloys. HF concentrations greater than about 10% generally result in hard to control reaction rates, poor surface quality and excessive hydrogen absorption.

It is generally accepted that HF permits attack of titanium alloys by dissolving the passive oxide layer that forms on the metal surface. The HF and $HNO_3$ dissolve the substrate, and the other additives control the rate and uniformity of metal removal, thus contributing to a process whereby metal can be removed rapidly but uniformly over large areas while attaining good surface quality.

Other factors affecting the rate of chemical reaction and metal removal from the surface include loading of the acid solution by metal removed, and the temperature of the acid bath during the reaction. To ensure uniform attack, the acid solution is generally agitated and the parts are often moved within the acid baths. Control of these factors generally results in closely predictable removal rates which provide accurate dimensional control of the finished article.

The chemical milling of alloys is always accompanied by the generation of hydrogen at the reaction surface and is often accompanied by absorption of hydrogen into the metal. This becomes particularly important in alloys susceptible to hydrogen embrittlement, for example, titanium alloys, where hydrogen absorption can result in a drastic reduction in ductility and fatigue life. Alpha titanium alloys are not particularly susceptible to hydrogen embrittlement, but the addition of alloying elements which stabilize the beta phase in the alpha phase titanium results in beta phase-containing alloys or beta alloys which are increasingly susceptible to hydrogen embrittlement.

Many techniques have been suggested for reducing hydrogen absorption during the chemical milling of titanium. Among these are included control of the concentrations of the various acids, and the addition of chromate ions, wetting agents, carbonic acid derivatives or chlorates. U.S. Pat. No. 3,846,188 describes a heat treatment applied to the titanium alloy prior to chemical milling which was shown to reduce hydrogen absorption.

While these techniques have been shown to reduce hydrogen absorption in some situations, they have proven ineffective in protecting certain titanium alloys which require acid solutions with greater than 10% HF for adequate chemical milling rates.

An objective of this invention is to provide a method for the chemical milling of metal alloys which removes metal rapidly while minimizing hydrogen absorption in the metal. As used herein, all references to percentages are to volume percentages, unless otherwise noted.

DISCLOSURE OF THE INVENTION

The present invention comprises the addition of a small but effective amount of a metal to an aqueous acid solution used for chemical milling to reduce hydrogen absorption by the workpiece. This technique works with any combination of acids used to chemically mill, etch or polish susceptible metals and alloys, and is particularly suited to solutions containing relatively high concentrations of HF. The metal added to the acid solution can be copper or any of the precious metals with the exception of silver (i.e., Ru, Rh, Pd, Os, Ir, Pt, Au). Hereinafter, this group of metals added to the acid solution will be referred to as electrochemically noble.

The foregoing and other features and advantages of the present invention will become more apparent from the following description and accompanying drawings.

BEST MODE FOR CARRYING OUT THE INVENTION

Initial attempts to chemically mill a titanium alloy having a nominal composition by weight of 35% vanadium, 15% chromium, 0.05–0.15% carbon, balance titanium, hereinafter referred to as Alloy C, indicated that the alloy was unusually resistant to attack by the acid solutions normally used. While the acid solutions normally used have an HF content less than about 10%, it was determined experimentally that HF concentrations of at least 10% and as high as 40% were required to provide reasonable rates of metal removal on Alloy C. When test pieces (half inch cubes) were chemically milled in these solutions, cracks formed spontaneously and portions of the test pieces broke away from the parent material, due to hydrogen embrittlement.

To reduce the amount of hydrogen absorbed by the Alloy C test pieces, various acid solutions and additions to the solution (e.g., chromate ions, wetting agents, carbonic acid derivatives or chlorates), hereinafter referred to as chemical milling solutions, were tried for the control of hydrogen absorption and found to be relatively ineffective.

Additions of small amounts of various metal ions were made to the acid solution, and some were found to substantially decrease the amount of hydrogen absorbed.

Referring to Table I which shows the results of chemically milling Alloy C in an acid solution containing 10% HF (48% by weight), 40% HCl (38.8% by weight), balance $H_3PO_4$ (100%) increasing the copper concentration in the acid solution decreased the amount of hydrogen absorbed in the test piece, and increased the amount of metal removed during the milling period.

TABLE I

| Millimoles Cu/liter Acid Solution | Thickness Change | ppm $H_2$ |
|---|---|---|
| 0 | 0.0103" | 959 |
| 7.4 | 0.0176" | 596 |
| 14.6 | 0.0168" | 505 |
| 29.3 | 0.0204" | 487 |
| 58.7 | 0.0229" | 441 |

Figure 1:
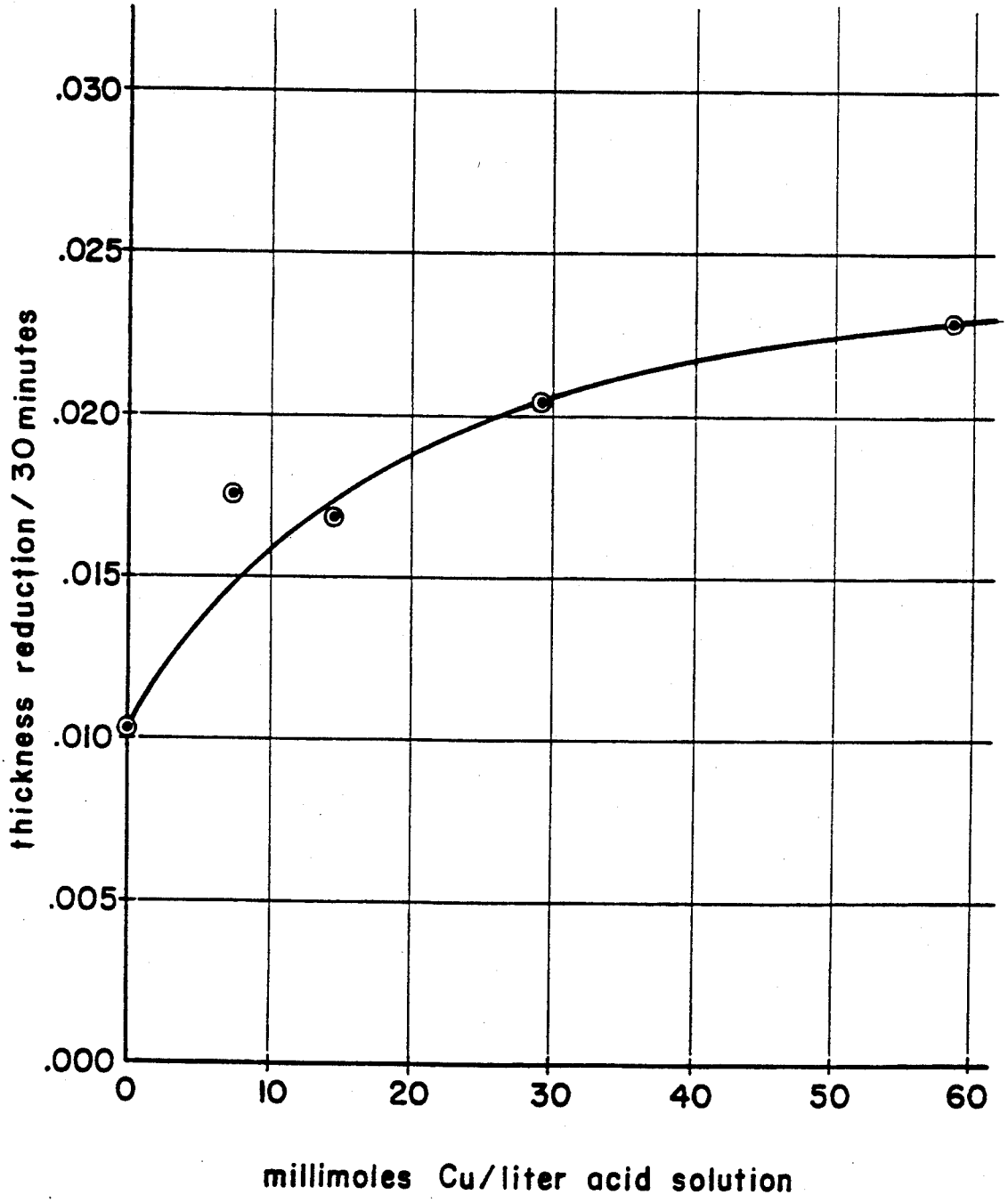
FIG. 1 is a graph which shows the relationship between the amount of material chemically removed from the surface of a metal sample and the electrochemically noble metal concentration in the acid bath.

Acid Solution: 10% HF, 40% HCl, balance $H_3PO_4$
Solution Temperature: 135° F.
Milling Time: 30 minutes
Test Piece: Alloy C, half-inch cube These results are shown graphically in FIGS. 1 through 3. FIG. 1 shows that the rate of thickness reduction of the test piece increased as the amount of copper added to the acid solution increased.

Figure 2:
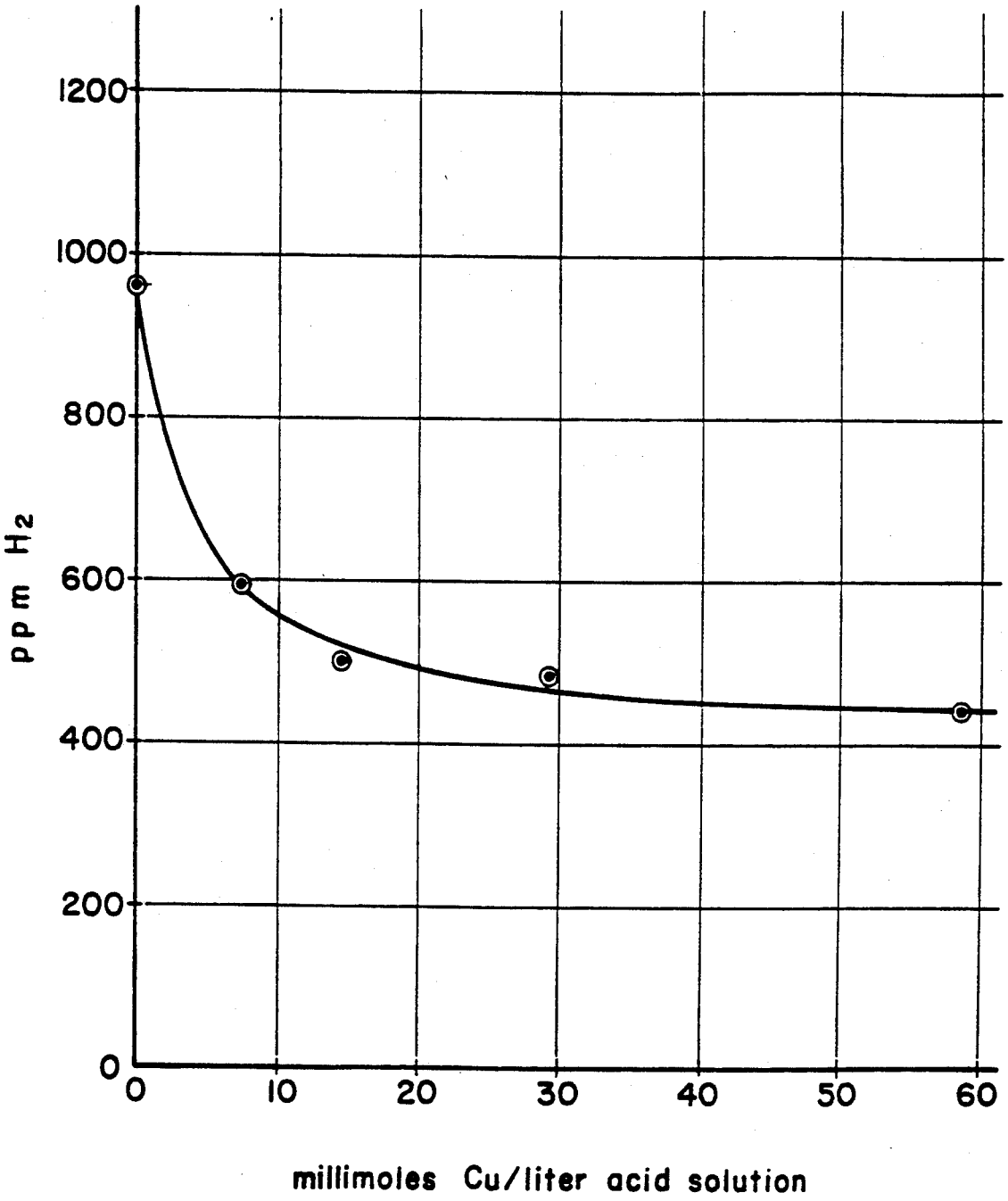
FIG. 2 is a graph which shows the relationship between the amount of hydrogen absorbed in the metal sample and the electrochemically noble metal concentration in the acid bath.

FIG. 2 shows that the amount of hydrogen absorbed by the test piece during the etching period decreased as the concentration of copper ions in the acid bath increased.

Figure 3:
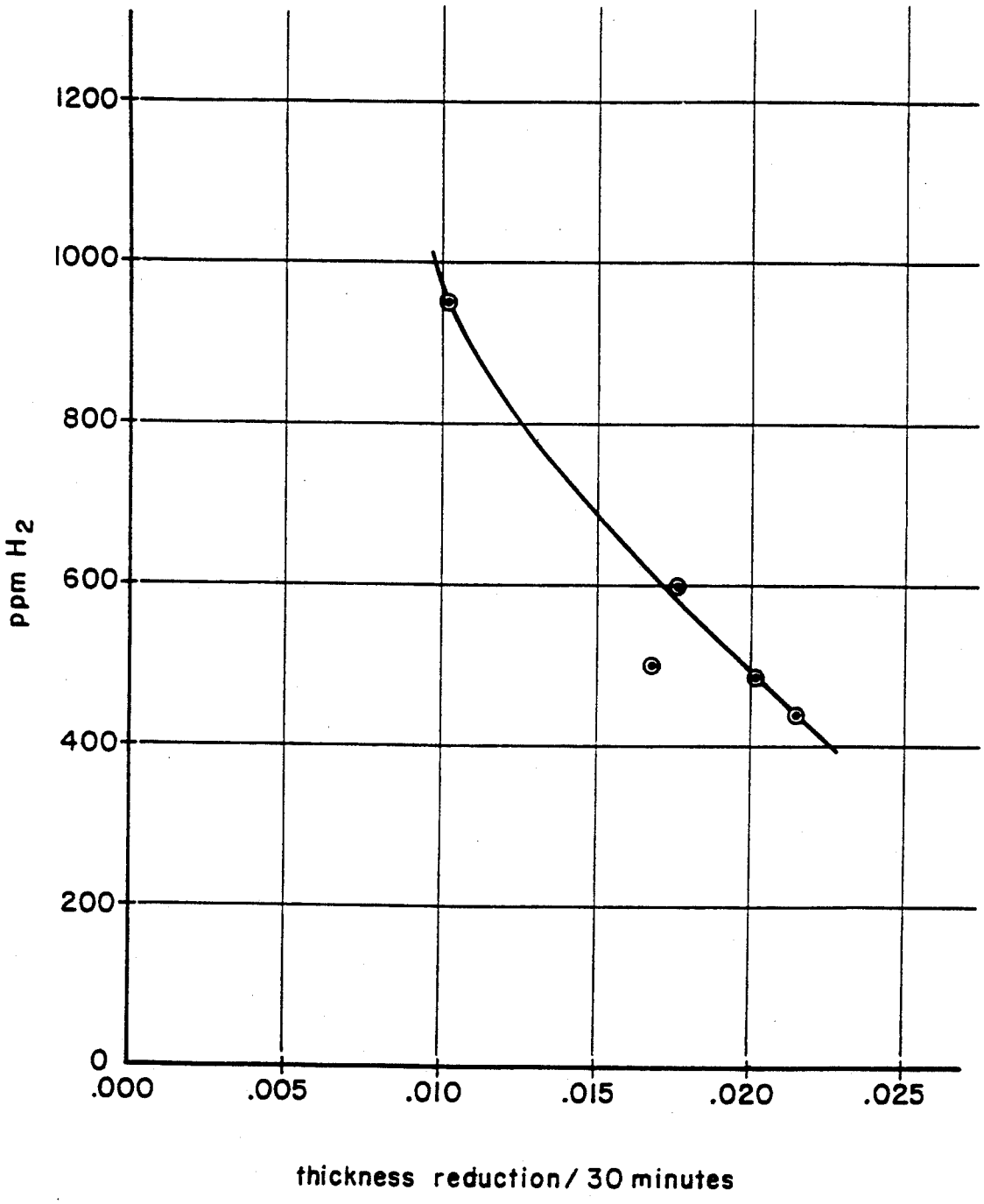
FIG. 3 is a graph which shows the relationship between the amount of metal removed and the hydrogen concentration in the metal sample.

FIG. 3 shows that, even though the removal rate due to acid attack at the surface of the test pieces increased, the amount of hydrogen absorbed by the test piece decreased. This relationship is not independent of those shown in FIGS. 1 and 2, but presents the same results from a different viewpoint.

Although the use of copper chloride as an additive to the acid bath was shown here to be effective in both increasing the rate of metal removal and decreasing the rate of hydrogen absorption, the resulting hydrogen content in the test pieces was still greater than that desirable based on the detrimental effect of the hydrogen on the material properties.

Having shown that adding Cu, a metal which is more electrochemically noble than the material being chemically milled, reduced hydrogen absorption, additional testing was performed using additions of precious metal salts, which are even more noble than Cu, to the acid solution. Table II shows the removal rate and hydrogen absorption results for chemically milling Alloy C with these precious metal additions to the same 10% HF acid solution. While significant decreases in hydrogen absorption are associated with the additions of palladium, ruthenium and platinum, the addition of silver to the acid solution actually increased the amount of hydrogen absorbed by the titanium alloy. Consequently, silver is excluded from the invention.

TABLE II

| Millimoles Metal/Liter Acid Solution | Thickness Change | ppm $H_2$ |
|---|---|---|
| 0 | 0.0103" | 959 |
| 8.71 Ag | 0.0098" | 1035 |
| 7.05 Pd | 0.0130" | 394 |
| 4.61 Ru | 0.0187" | 180 |
| 2.72 Pt | 0.0075" | 203 |

Acid Solution: 10% HF, 40% HCl, balance $H_3PO_4$
Solution Temperature: 135° F.
Milling Time: 30 minutes
Test Piece: Alloy C, half-inch cube Table III shows the results of chemically milling Alloy C test pieces in an acid solution consisting of 40% HCl, 20% HF, 10% $H_2SO_4$ (100%), balance $H_2O$ with various amounts of precious metal salts added. Again the additions of palladium, ruthenium and platinum significantly decreased the amount of hydrogen absorbed by the titanium alloy, copper provided a less significant reduction in hydrogen absorption, and silver increased the amount of hydrogen absorbed.

TABLE III

| Millimoles Metal/Liter Acid Solution | Thickness Change | ppm $H_2$ |
|---|---|---|
| 0 | 0.0047" | 484 |
| 4.41 Cu | 0.0060" | 384 |
| 5.56 Ag | 0.0071" | 610 |
| 5.64 Pd | 0.0120" | 143 |
| 4.45 Ru | 0.0183" | 186 |
| 5.59 Pt | 0.0126" | 141 |

Acid Solution: 10% $H_2SO_4$, 20% HF, 40% HCl, balance $H_2O$
Solution Temperature: 85° F.
Exposure Time: 30 minutes
Test Piece: Alloy C, half-inch cube The experimental results indicate that members of the precious metals group with the exception of silver can be expected to effectively reduce the rate of hydrogen absorption in chemically milling titanium alloys. The results also show that copper is effective although not to as significant an extent as the precious metals, but could be satisfactory as a lower cost additive where the increased protection afforded by the precious metals is not required.

Table IV shows the results of chemically milling Alloy C test pieces in a solution of 20% HF, 30% $HNO_3$ (70% by weight), balance $H_2O$. Again, increasing the palladium addition to the acid solution decreased the amount of hydrogen absorbed by the titanium alloy.

TABLE IV

| Millimoles Pd/liter Acid Solution | ppm $H_2$ |
|---|---|
| .053 | 340 |
| .105 | 179 |

TABLE IV-continued

| Millimoles Pd/liter Acid Solution | ppm $H_2$ |
|---|---|
| .210 | 115 |

Although increasing the palladium concentration in the acid solution would probably continue to decrease the absorbed hydrogen content, the cost becomes prohibitive. With the hydrogen content at an acceptable level, there is no incentive for further increase.

To increase the milling rate and retain an acceptable surface condition on the chemically milled material, various modifications and additions were made to the basic HF-$HNO_3$ solution. Nitric acid concentrations between 30 and 50 percent were found to be acceptable. At least 30% $HNO_3$ was found to be essential to reduce the hydrogen content while greater than 50% $HNO_3$ had a detrimental effect on the milling rate. At least 10% HF was required for a satisfactory milling rate but more than approximately 45% increased the hydrogen absorption.

Electrochemically noble metal additions to the acid solution in the range from 0.05 to 0.25 millimoles per liter were found to be suitable. Below 0.05 millimoles per liter, the hydrogen absorption was not reduced adequately, while concentrations greater than 0.25 millimoles per liter would be cost prohibitive. It was determined that additions of ammonium formate up to 10 grams per liter and citric acid up to 15 grams per liter of acid solution were effective in increasing the milling rate and reducing hydrogen absorption. However, concentrations greater than these amounts tended to decrease the milling rate. Finally, the addition of an anionic or non-ionic surfactant was found to improve the surface finish of the chemically milled metal, due to allowing more uniform contact of the acid solution with the surface of the metal. For example, sodium lauryl sulfate, such as supplied by Proctor and Gamble under the trade name ORVUS WA TM, proved to be effective up to a concentration of approximately 0.4 grams per liter of acid solution, above which foaming of the solution became excessive.

This testing demonstrated that the optimum milling solution contained about 40 percent $HNO_3$, 40 percent HF, balance water, with additions of 3.5 grams per liter ammonium formate, 10.75 grams per liter citric acid, 0.19 millimoles per liter of the electrochemically noble metal and 0.225 grams per liter of the surfactant. The most satisfactory operating temperature range was found to be 110° to 115° F. Below 110° F., the milling rate was slower than desired and above 115° F., the evaporation rate of the acid components of the milling solution proved to be excessive.

The results showing the effectiveness of these metal additions in different acid solutions in reducing the rate of hydrogen absorption suggest that the same effect should occur in other acid solutions which are used for the chemical milling of metal alloys. The selection of acid solution compositions and operating conditions such as solution temperature will be obvious from observation or with minimal experimentation to those of average skill in the art, as will be the selection of appropriate metal salt additions, wherein such factors as salt solubility in the acid solution and potential adverse interactions with the workpiece must be considered.

It will also be apparent that more than one electrochemically noble metal species dissolved in the acid solution may have beneficial effects not seen with a single metal in the solution, and that techniques other than dissolution of a metal salt, for example electrolysis, may be used to provide the desired electrochemically noble metal content in the acid solution.

Although this invention has been shown and described with respect to detailed embodiments thereof, it will be understood by those skilled in the art that various changes in form and detail thereof may be made without departing from the spirit and scope of the claimed invention.

We claim:

1. A solution for chemically milling metal which is subject to embrittlement by absorption of hydrogen in an acid solution, comprising 30–50 percent $HNO_3$ (70% by weight), 10–45 percent HF (48% by weight), balance $H_2O$ to which is added up to 10 grams per liter ammonium formate, up to 15 grams per liter citric acid, up to 0.4 grams per liter of a surfactant, and 0.05–0.25 millimoles of a metal chosen from the group consisting of Cu, Ru, Rh, Pd, Os, Ir, Pt and Au and combinations thereof per liter of said acid solution.

2. The solution as recited in claim 1, wherein said acid solution consists of about 40 percent $HNO_3$, about 40 percent HF, balance $H_2O$ to which is added about 3.5 grams per liter ammonium formate, about 10.75 grams per liter citric acid, an anionic or non-ionic surfactant, and about 0.19 millimoles of said metal per liter of said acid solution.

3. The solution as recited in claim 2, wherein said surfactant is sodium lauryl sulfate.

4. A method of chemically milling metal which is susceptible to embrittlement by hydrogen whereby a surface of said metal is contacted by the chemical milling solution as recited in claim 1 at a temperature between about 110° F. and 115° F. for a time sufficient to remove the desired amount of metal.

* * * * *